US006851934B2

(12) United States Patent
Yoo et al.

(10) Patent No.: US 6,851,934 B2
(45) Date of Patent: Feb. 8, 2005

(54) STROKE CONTROL APPARATUS OF RECIPROCATING COMPRESSOR AND METHOD THEREOF

(75) Inventors: Jae-Yoo Yoo, Gwangmyeong (KR); Chel Woong Lee, Seoul (KR); Min-Kyu Hwang, Gwangmyeong (KR)

(73) Assignee: LG Electronics Inc., Seoul (KR)

( * ) Notice: Subject to any disclaimer, the term of this patent is extended or adjusted under 35 U.S.C. 154(b) by 67 days.

(21) Appl. No.: 10/128,495

(22) Filed: Apr. 24, 2002

(65) Prior Publication Data

US 2003/0026702 A1 Feb. 6, 2003

(30) Foreign Application Priority Data

Jul. 31, 2001 (KR) ..... 2001-46224

(51) Int. Cl.[7] ..... F04B 49/06

(52) U.S. Cl. ..... 417/44.11; 417/44.1; 417/53

(58) Field of Search ..... 417/53, 44.1, 44.11, 417/45, 18, 212, 417

(56) References Cited

U.S. PATENT DOCUMENTS 4,345,442 A * 8/1982 Dorman ..... 62/160
4,353,220 A * 10/1982 Curwen et al. ..... 62/228.1
4,783,807 A * 11/1988 Marley ..... 704/235
5,658,132 A * 8/1997 Akazawa et al. ..... 417/45
5,897,296 A * 4/1999 Yamamoto et al. ..... 417/44.1
5,947,693 A * 9/1999 Yang ..... 417/45
5,980,211 A * 11/1999 Tojo et al. ..... 417/45
6,074,172 A * 6/2000 Huang ..... 417/214
6,084,320 A * 7/2000 Morita et al. ..... 310/12
6,153,951 A * 11/2000 Morita et al. ..... 310/12
6,176,683 B1 * 1/2001 Yang ..... 417/44.1
6,231,310 B1 * 5/2001 Tojo et al. ..... 417/44.1
6,289,680 B1 * 9/2001 Oh et al. ..... 62/6
6,501,240 B2 * 12/2002 Ueda et al. ..... 318/135
6,685,438 B2 * 2/2004 Yoo et al. ..... 417/44.11
2002/0051710 A1 * 5/2002 Yoo et al. ..... 417/44.11
2002/0064462 A1 * 5/2002 Park et al. ..... 417/44.1
2002/0064463 A1 * 5/2002 Park et al. ..... 417/44.1
2002/0064464 A1 * 5/2002 Hwang et al. ..... 417/44.11
2003/0026703 A1 * 2/2003 Yoo et al. ..... 417/44.11
2003/0099550 A1 * 5/2003 Kim ..... 417/44.11
2003/0129063 A1 * 7/2003 Jeun ..... 417/45
2003/0161734 A1 * 8/2003 Kim ..... 417/44.1
2003/0161735 A1 * 8/2003 Kim et al. ..... 417/44.1
2003/0164691 A1 * 9/2003 Ueda et al. ..... 318/135

* cited by examiner

*Primary Examiner*—Cheryl J. Tyler
*Assistant Examiner*—William H. Rodriguez
(74) *Attorney, Agent, or Firm*—Birch, Stewart, Kolasch & Birch, LLP

(57) ABSTRACT

In a stroke control apparatus of a reciprocating compressor and a method thereof, the stroke control apparatus of the reciprocating compressor includes a reciprocating compressor, a current detecting unit for detecting a current flowing in a motor of the reciprocating compressor, a stroke detecting unit for detecting a piston stroke by using a voltage and a current applied to the motor of the reciprocating compressor, a phase difference detecting unit for detecting a phase difference by receiving the piston stroke from the stroke detecting unit and the motor current from the current detecting unit, an operational frequency determining unit for determining an operational frequency corresponded to an operation region according to the detected phase difference, a frequency/stroke storing unit for storing a piston stroke value by the determined operational frequency, a reference stroke value determining unit for determining a reference stroke value corresponded to the determined operational frequency by using the stroke value pre-stored in the frequency/stroke storing unit, a control unit for comparing the reference stroke value with a present piston stroke value after a certain time point and outputting a stroke control signal according to the comparison result and an inverter for varying an operational frequency and a voltage applied to the motor of the reciprocating compressor according to the stroke control signal of the control unit.

17 Claims, 7 Drawing Sheets

LOAD1>LOAD2>LOAD3

FREQUENCY3>FREQUENCY2>FREQUENCY1

STROKE CONTROL APPARATUS OF RECIPROCATING COMPRESSOR AND METHOD THEREOF

BACKGROUND OF THE INVENTION

1. Field of the Invention

The present invention relates to a stroke control apparatus of a reciprocating compressor and a method thereof, and in particular to a stroke control apparatus of a reciprocating compressor and a method thereof which are capable of improving an operational efficiency of a reciprocating compressor by detecting a phase difference between a stroke and a current and varying an operational frequency so as to make an operation distance of a stroke place near TDC (top dead center)=0 in every load variation.

2. Description of the Prior Art

A general reciprocating compressor generates a torque according to rotation of a motor by intermitting power applied to a coil wound around a polyphase stator of the motor by using a switching device and generates a torque according to rotation according to a magnetic sucking force by varying an excitation state between a rotor and a stator gradually.

FIG. 1 is a block diagram illustrating a construction of the conventional stroke control apparatus of a reciprocating compressor.

As depicted in FIG. 1, the conventional stroke control apparatus of the reciprocating compressor includes a reciprocating compressor 10 adjusting a cooling capacity by moving a piston up and down and varying a stroke, a current detecting unit 20 detecting a current generated in the reciprocating compressor 10, a stroke detecting unit 30 detecting a stroke of the piston according to a voltage applied to the reciprocating compressor 10, a phase difference detecting unit 40 detecting a difference value of each phase of the current and the stroke detected in the current detecting unit 20 and the stroke detecting unit 30, a stroke vibration detecting unit 50 detecting stroke vibration by using a variation quantity of the detected phase difference, a stroke control unit 60 detecting the stroke vibration, calculating a stroke occurred in the operation of the reciprocating compressor 10 according to an expected cooling capacity set by a user, comparing the calculated stroke with a reference stroke value inputted by the user in an early operation of the reciprocating compressor 10 and outputting a switching control signal for stroke control, and an inverter 70 receiving a switching control signal for the stroke control and operating the reciprocating compressor 10.

Hereinafter, the operation of the conventional stroke control apparatus of the reciprocating compressor will be described.

First, the piston of the reciprocating compressor 10 performs a linear reciprocation motion by a stroke input voltage according to an initial reference stroke value set by the user, a stroke as an operation distance of the piston is determined by the linear reciprocation motion of the piston, accordingly a cooling capacity is controlled by varying the stroke. Herein, the current detecting unit 20 and the stroke detecting unit 30 detect a current and a stroke of the reciprocating compressor 10.

After that, the phase difference detecting unit 40 detects a phase by using the detected current and stroke, calculates a difference value according to it and judges a stroke vibration by using a variation quantity of the phase difference.

In the early operation of the reciprocating compressor 10, the stroke control unit 60 controls the operation of the reciprocating compressor 10 according to the initial reference stroke value, when a stroke vibration detecting signal is inputted from the stroke vibration detecting unit 50 in the operation of the reciprocating compressor 10, the stroke control unit 60 inputs an inverting signal to the inverter 70.

As described above, an operation control for operating the reciprocating compressor 10 at a maximum efficiency point is performed.

However, since the reciprocating compressor control apparatus according to the prior art has a severe non-linearity in its mechanical motion functions, the operation of the reciprocating compressor can not be performed precisely and accurately by a linear control method without considering the non-linearity. An operational efficiency may be improved by detecting an inflection point of a phase difference between a current and a stroke of the reciprocating compressor and performing an operation control according to it, but when the reciprocating compressor is operated continually, an operational efficiency may be lowered due to a load variation according to changes in surrounding circumstances.

SUMMARY OF THE INVENTION

Accordingly, in order to solve the above-mentioned problem, it is an object of the present invention to provide a stroke control apparatus of a reciprocating compressor and a method thereof capable of improving an operational efficiency by detecting a phase difference between a stroke and a current and varying an operational frequency in load variations.

In order to achieve the above-mentioned object, a stroke control apparatus of a reciprocating compressor in accordance with the present invention includes a reciprocating compressor, a current detecting unit for detecting a current flowing in a motor of the reciprocating compressor, a stroke detecting unit for detecting a piston stroke by using a voltage and a current applied to the motor of the reciprocating compressor, a phase difference detecting unit for detecting a phase difference by receiving the piston stroke from the stroke detecting unit and the motor current from the current detecting unit, an operational frequency determining unit for determining an operational frequency corresponded to an operation region according to the detected phase difference, a frequency/stroke storing unit for storing a piston stroke value by the determined operational frequency, a reference stroke value determining unit for determining a reference stroke value corresponded to the determined operational frequency by using the stroke value pre-stored in the frequency/stroke storing unit, a control unit for comparing the reference stroke value with a present piston stroke value after a certain time point and outputting a stroke control signal according to the comparison result and an inverter for varying an operational frequency and a voltage applied to the motor of the reciprocating compressor according to the stroke control signal of the control unit.

In addition, a stroke control method of a reciprocating compressor in accordance with the present invention includes detecting a load variation while a reciprocating compressor operates with a reference operational frequency, detecting an operational frequency in an operation region by increasing/decreasing an operational frequency when the load variation is detected and performing a stroke control according to a reference stroke value after determining the reference stroke value corresponded to the operational frequency in a high efficiency operation region.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Hereinafter a stroke control apparatus of a reciprocating compressor and a method thereof in accordance with the present invention will be described with reference to accompanying drawings.

Figure 1:
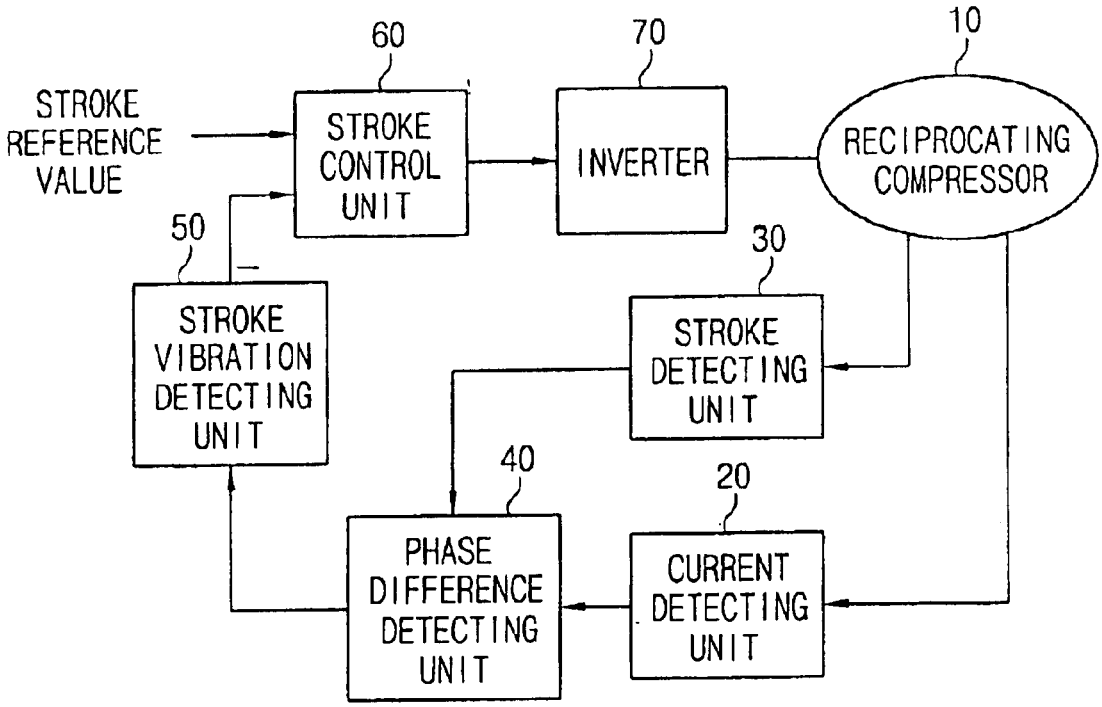
FIG.1 CONVENTIONAL ART
FIG. 1 is a circuit diagram illustrating a construction of the conventional stroke control apparatus of a reciprocating compressor.
Figure 2:
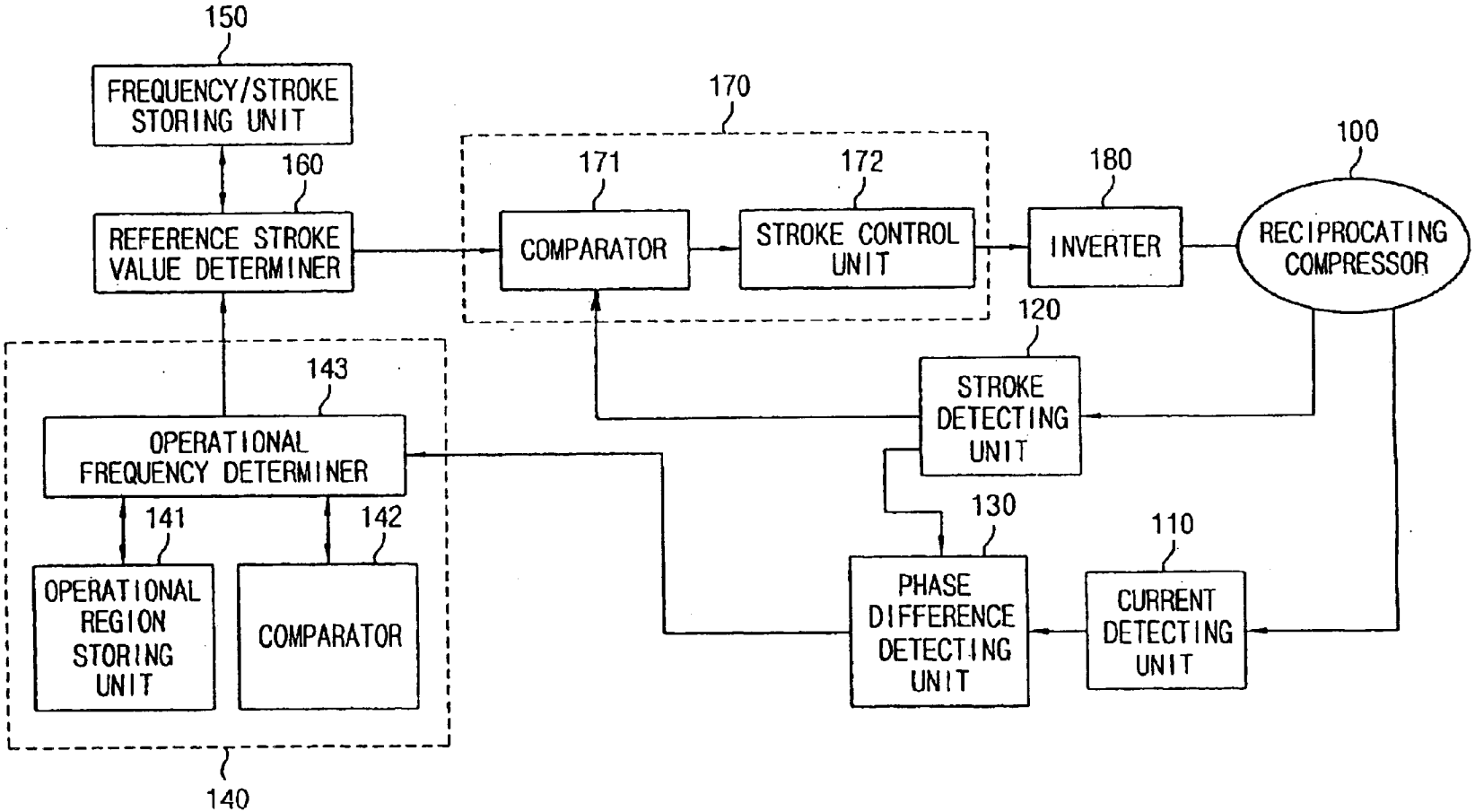
FIG. 2 is a block diagram illustrating a construction of a stroke control apparatus of a reciprocating compressor in accordance with the present invention.

FIG. 2 is a block diagram illustrating a construction of a stroke control apparatus of a reciprocating compressor in accordance with the present invention. As depicted in FIG. 2, a stroke control apparatus of a reciprocating compressor in accordance with the present invention includes a reciprocating compressor 100 adjusting a cooling capacity by moving a piston up and down and varying a stroke by a voltage applied to a motor according to a reference stroke value set by a user, a current detecting unit 110 detecting a current flowing in the motor of the reciprocating compressor 100, a stroke detecting unit 120 detecting a piston stroke by using a voltage and a current applied to the motor of the reciprocating compressor 100, a phase difference detecting unit 130 detecting a phase difference by receiving the piston stroke from the stroke detecting unit 120 and the motor current from the current detecting unit 110, an operational frequency determining unit 140 pre-storing an operational frequency corresponded to an operation region of a phase difference detected through experiments, judging whether the phase difference detected in the phase difference detecting unit 130 is included in the phase difference operation region and determining an operational frequency in order to operate the reciprocating compressor 100 within the operation region, a frequency/stroke storing unit 150 pre-storing a piston stroke value by each operational frequency, a reference stroke value determiner 160 determining a reference stroke value corresponded to the operational frequency outputted from the operational frequency determining unit 140 by using the stroke value pre-stored in the frequency/stroke storing unit 150, a control unit 170 for comparing the reference stroke value with a present piston stroke value and outputting a stroke control signal according to a comparison result, and an inverter 180 for varying a voltage applied to the motor of the reciprocating compressor 100 by varying an operational frequency by the stroke control signal of the control unit 170.

Herein, the operational frequency determining unit 140 includes an operational region storing unit 141 for pre-storing an operational frequency corresponded to an operation region of the phase difference detected through experiments in advance in order to operate the reciprocating compressor 100 within the operation region, a comparator 142 comparing the phase difference detected in the phase difference detecting unit 130 with the phase difference operation region, and an operational frequency deteminer 143 increasing/decreasing the reference operational frequency by a certain frequency units and determining a frequency at a certain time point as an operational frequency according to a comparison signal of the comparator 142 when a phase difference between the current and the piston stroke is in the operation region at the time point.

In addition, the control unit 170 includes a comparator 171 comparing a reference stroke value with a present piston stroke and a stroke controlling unit 172 outputting a stroke control signal for operating the reciprocating compressor according to the comparison result.

Hereinafter, the operation and advantages of the stroke control apparatus of the reciprocating compressor in accordance with the present invention will be described with reference to accompanying drawings.

In the stroke control apparatus of the reciprocating compressor in accordance with the present invention, an operational frequency is varied in order to make the motor operate within an operation region having a phase difference between a piston stroke and a current as $90°\pm\delta$. The current detecting unit 110 detects a current applied to the motor of the compressor 100, the stroke detecting unit 120 detects a piston stroke by using the voltage and the current applied to the motor and respectively outputs the detected current and the stroke to the phase difference detecting unit 130. After that, the operational frequency determiner 143 of the operational frequency determining unit 140 receives the phase difference from the phase difference detecting unit 130 and determines an operational frequency.

Herein, a process for determining an operational frequency will be described.

First, when the reciprocating compressor 100 is in a mechanical resonance state (maximum efficiency point of an operational frequency), the operation region storing unit 141 stores a certain value ($\pm\delta$) on the basis of a point at which a phase difference between the motor current and the piston stroke is 90°. Herein, the certain value is determined through experiments.

Then, the operational efficiency of the reciprocating compressor 100 according to the load variation will be described with reference to accompanying drawings.

Figure 3:
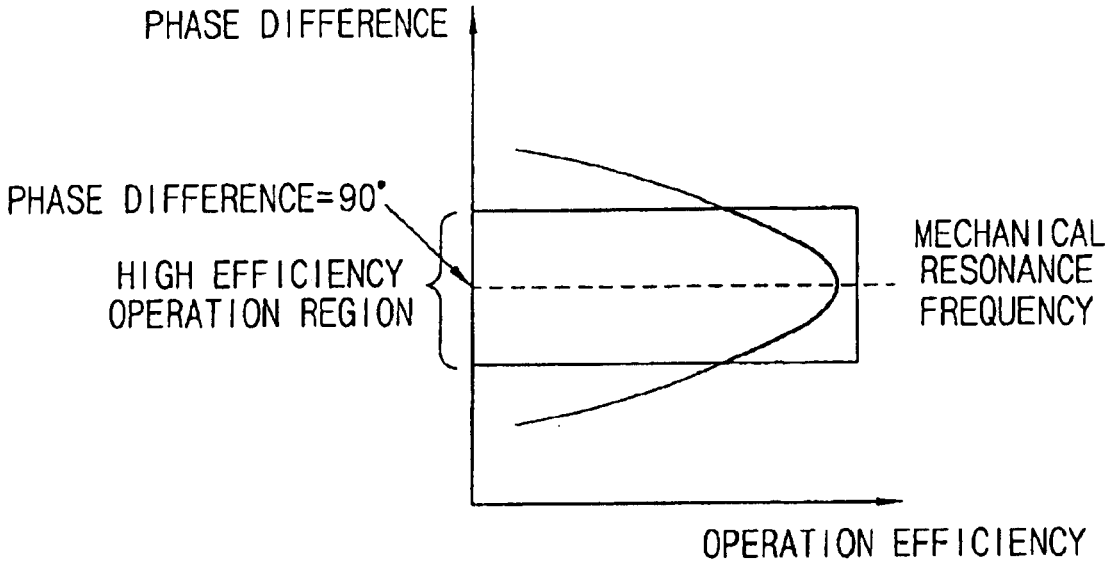
FIG. 3 is an exemplary view illustrating a stable operation region of a reciprocating compressor.

FIG. 3 is an exemplary view illustrating a stable operational region of a reciprocating compressor.

As depicted in FIG. 3, an operational efficiency of the reciprocating compressor 100 is maximum at a point at which a phase difference between the motor current and the piston stroke detected in the phase difference detecting unit 130 is 90°.

After that, the comparator 142 receives a phase difference between the piston stroke and the current outputted from the phase difference detecting unit 130, compares the phase difference with the operation region pre-stored in the operation region storing unit 141 and applies a comparison signal according to the comparison result to the operational frequency determiner 143.

When an inflection point of the phase difference gets out of the operation region according to load variation of the reciprocating compressor 100, the operational frequency determiner 143 increases/decreases the operational frequency by a certain frequency units in order to make the inflection point of the phase difference between the current and the piston stroke place within the operation region. After that, the operational frequency controlled by placing the phase difference inflection point within the operation region is outputted to the reference stroke value determiner 150.

However, when the phase difference inflection point is placed within the operation region, a frequency at that time point is determined as an operational frequency and directly outputted to the reference stroke value determiner 160. Herein, the operational frequency determiner 143 applies the controlled operational frequency to the reference stroke value determiner 160 according to a comparison signal from the comparator 142.

According to it, the reference stroke value determiner 160 receives the operational frequency from the operational frequency determining unit 140 and determines a reference stroke value. Herein, the frequency/stroke storing unit 150 calculates a piston stroke corresponded to the operational frequency outputted from the operational frequency determining unit 140 through experiments and stores it, and the reference stroke value determiner 160 reads the piston stroke corresponded to the operational frequency and determines it as a reference stroke value.

After that, the control unit 170 constructed with the comparator 171 and the stroke controller 172 applies a stroke control signal for operating the reciprocating compressor 100 to the inverter 180, a process for generating the stroke control signal will be described.

First, the comparator 171 of the control unit 170 receives a reference stroke value outputted from the reference stroke value determiner 160, compares the reference stroke value with a piston stroke of the stroke detecting unit 120 and outputs a stroke control signal according to the comparison result. In more detail, the comparator 171 compares the reference stroke value with the piston stroke and outputs a difference value, the stroke controller 172 generates a compensated stroke control signal according to the difference value and applies it to the inverter 180.

After that, the inverter 180 varies a voltage applied to the motor by varying an operational frequency according to the stroke control signal outputted from the control unit 170, accordingly the operation control for making the reciprocating compressor 100 operate in the operation region, namely, at a maximum efficiency point can be performed.

Hereinafter, each performing process of a stroke control method of a reciprocating compressor in accordance with the present invention will be described in more detail.

A stroke control method of a reciprocating compressor in accordance with the present invention includes detecting a load variation while the reciprocating compressor is operated according to a reference operational frequency, detecting an operational frequency in an operation region by increasing/decreasing the operational frequency when the load variation is detected, and performing a stroke control according to a reference stroke value after determining the reference stroke value corresponded to the operational frequency in a high efficiency operation region.

Figure 4:
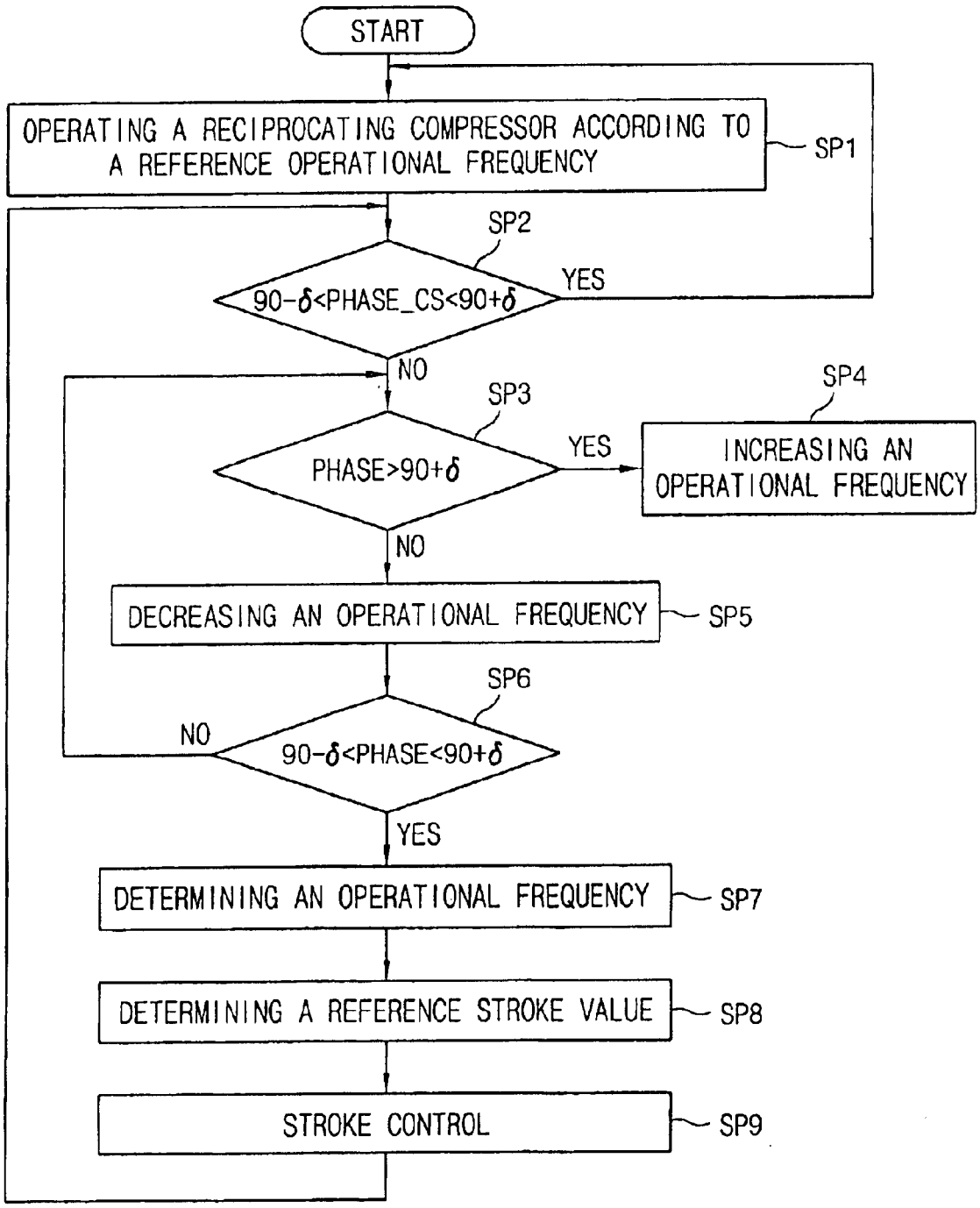
FIG. 4 is a flow chart illustrating a stroke control method of a reciprocating compressor in accordance with the present invention.

FIG. 4 is a flow chart illustrating the stroke control method of the reciprocating compressor in accordance with the present invention. It will be described in detail with reference to accompanying FIGS. 5~7.

First, a load variation is detected as shown at steps SP1, SP2 while the reciprocating compressor 100 is operated by a reference operational frequency according to a reference stroke. Herein, the load variation can be detected by checking whether an inflection point of a phase difference (PHASE-CS) between a piston stroke and a motor current is placed within a certain operation region (90°−δ~90°+δ). Herein, as depicted in FIG. 5, the inflection point of the phase difference (PHASE-CS) between the piston stroke and the motor current is varied according to increase/decrease of a mechanical resonance frequency due to the load variation.

Figure 5:
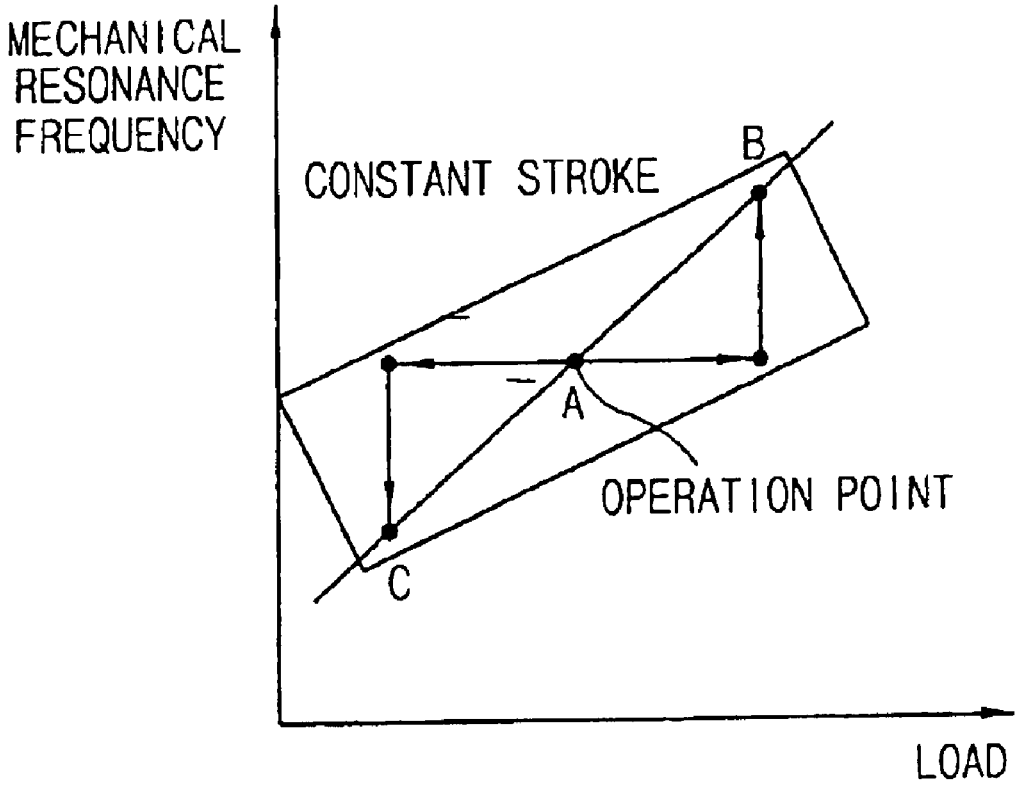
FIG. 5 is a graph illustrating variation of a mechanical resonance frequency according to load variation of a reciprocating compressor.

FIG. 5 is a graph illustrating variation of a mechanical resonance frequency according to variation of a load of a reciprocating compressor. As depicted in FIG. 5, when a stroke of the reciprocating compressor 100 is uniform and a load of the reciprocating compressor 100 is increased, an operation point of the reciprocating compressor 100 is moved from 'A' point to 'B' point. In more detail, a mechanical resonance frequency is increased.

However, when a load is decreased, the operation point of the reciprocating compressor 100 is moved from 'A' point to 'C' point. In more detail, a mechanical resonance frequency is decreased. As described above, when the mechanical resonance frequency is varied according to the load variation of the reciprocating compressor 100, a maximum efficiency point, namely, an operation region of the reciprocating compressor 100 is varied.

In result, by increase/decrease of the mechanical resonance frequency due to the load variation of the reciprocating compressor 100, a stroke control of the reciprocating compressor 100 is not performed well. Accordingly, in order to compensate increase/decrease of the mechanical resonance frequency due to the load variation, the stroke control is performed by varying the operational frequency so as to make an inflection point of the phase difference (PHASE-CS) of the stroke and the motor current place within the operation region.

After that, when the load variation is detected, in more detail, when the inflection point of the phase difference (PHASE-CS) of the stroke and the motor current places within the certain operation region (90°−δ~90°+δ), the operation is continually performed with the reference operational frequency inputted in the early operation of the reciprocating compressor. When the inflection point of the phase difference (PHASE-CS) of the stroke and the motor current does not place within the certain operation region (90°−δ~90°+δ), it is judged whether the inflection point of the phase difference (PHASE-CS) has a value greater than that of the certain operation region (90°+δ) as shown at step SP3.

When the inflection point of the phase difference (PHASE-CS) has a value greater than the certain operation region (90°+δ), an operational frequency is increased as shown at step SP4, when the inflection point of the phase difference (PHASE-CS) have a value smaller than the certain operation region (90°+δ), an operational frequency is decreased as shown at step SP5, then it is judged whether the decreased operational frequency places within the operation region (90°−δ~90°+δ) as shown at step SP6, when the decreased operational frequency places within the operation region (90°−δ~90°+δ), the decreased operational frequency is judged as an operational frequency as shown at step SP&. When the decreased operational frequency does not place within the operation region (90°δ~90°+67 ), the step SP3 is performed until an operational frequency places within the operation region (90°−δ~90°+67 ).

Figure 6A:
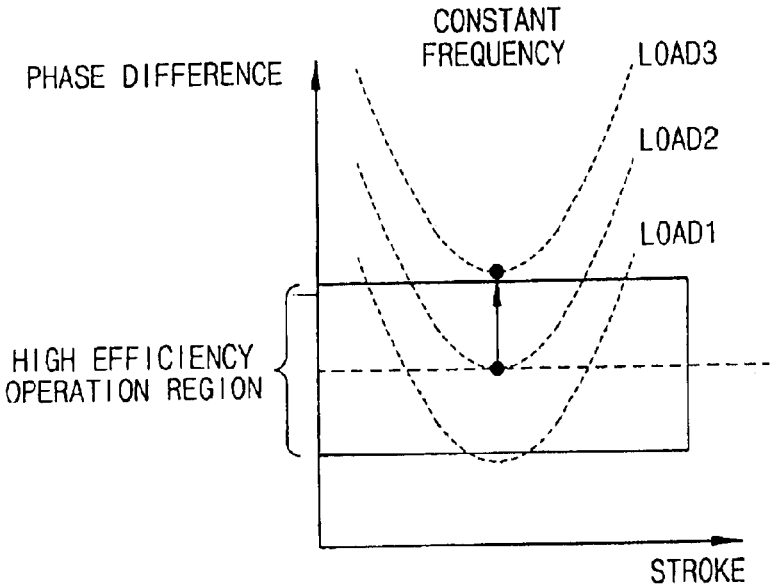
FIG. 6A is a graph illustrating variation of an operation point of a reciprocating compressor according to load variation when an operational frequency of the reciprocating compressor is uniform.
Figure 6B:
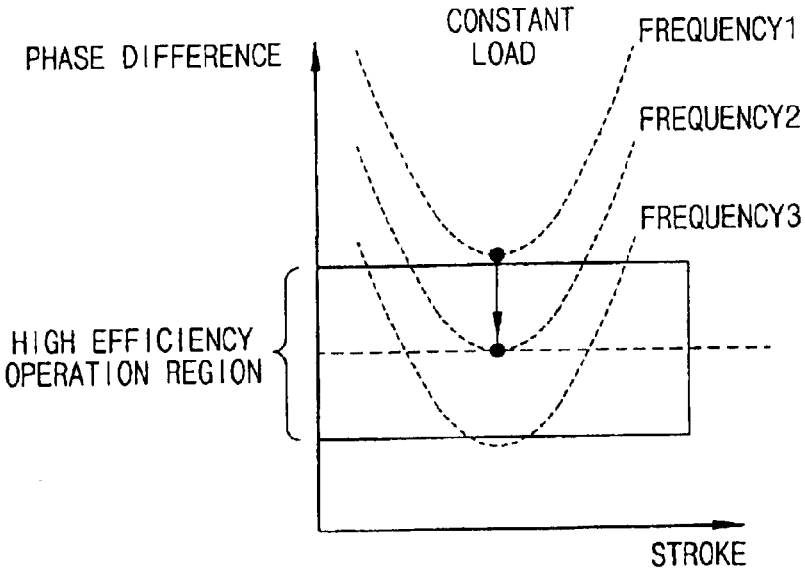
FIG. 6B is a graph illustrating variation of an operation point of a reciprocating compressor according to variation of an operational frequency when a load of the reciprocating compressor is uniform.

Herein, as depicted in FIGS. 6A and 6B, an operational frequency is determined by using a graph illustrating a relation between a variation of a phase difference due to a load variation and an operational frequency according to a phase difference variation.

FIG. 6A and 6B are graphs illustrating variation of a phase difference inflection point according to a load variation of a reciprocating compressor and variation of an operational frequency according to the variation of the phase difference inflection point. As depicted in FIGS. 6A and 6B, an operation control is performed by compensating a load variation of the reciprocating compressor by using characteristics of the two characteristic curves.

Figure 7:
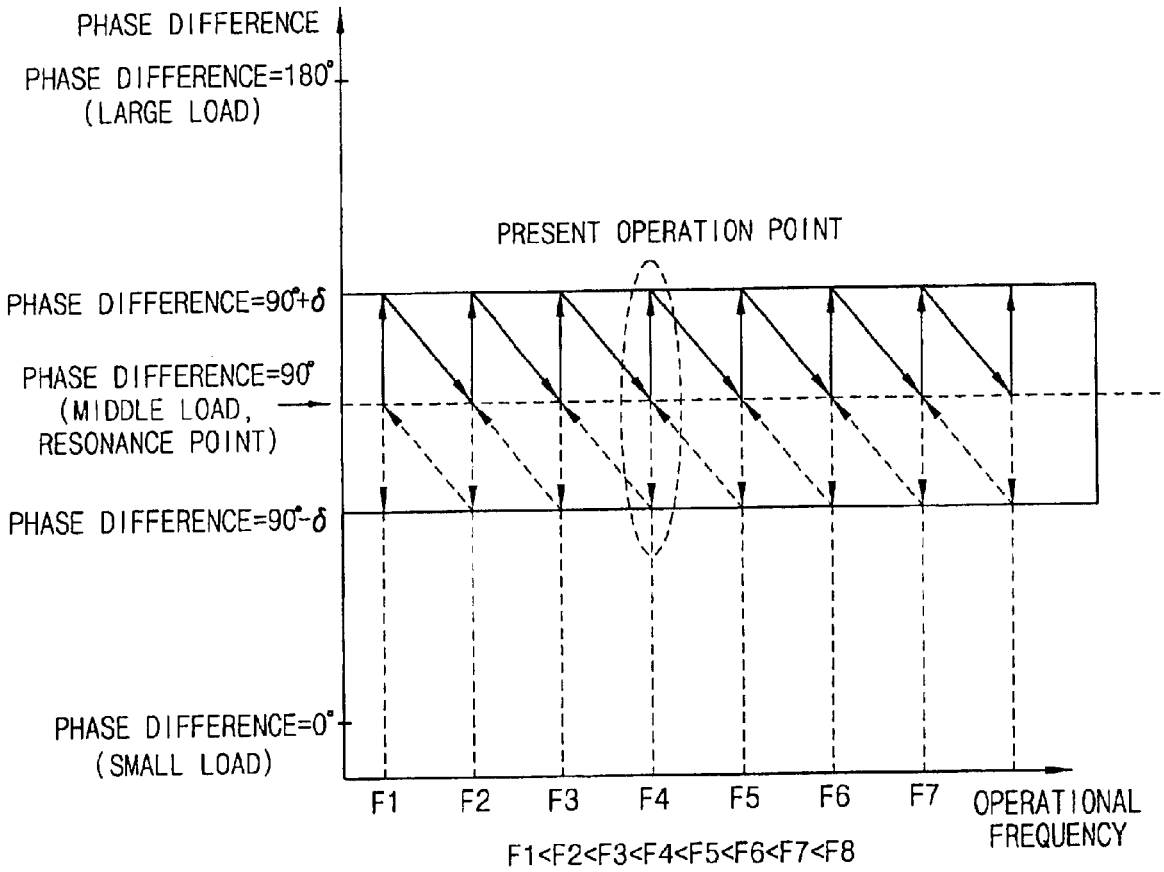
FIG. 7 is an exemplary view illustrating a stroke control by increasing an operational frequency according to a load variation of a reciprocating compressor.

When an inflection point of a phase difference between a piston stroke and a current is varied according to a load variation of the reciprocating compressor, an inflection point of a phase difference (PHASE-CS) between the piston stroke and the current places in a high efficiency operation region by increasing/decreasing an operational frequency. In more detail, when a load is increased while the reciprocating compressor is operated in the high efficiency operation region, the reciprocating compressor gets out of the high efficiency operation region. Herein, the reciprocating compressor returns to the high efficiency operation region by increasing an operational frequency as a certain value. FIG. 7 illustrates a control process in detail.

FIG. 7 is an exemplary view illustrating stroke control by increasing an operational frequency about load variation of a reciprocating compressor.

As depicted in FIG. 7, when the reciprocating compressor is operated at a constant velocity on a certain operation time point, if a load variation is not heavy, a phase difference between the piston stroke and the current places in a stable operation region, accordingly an operational frequency is not varied.

However, when an operation point is greater than the stable operation region due to a load increase, an operational frequency is moved in a dotted line direction, when an operation point is smaller than the stable operation region due to a load decrease, an operational frequency is moved in a dotted line direction. Accordingly, although a load variation occurs, an operational efficiency of a compressor 100 can be improved by varying an operational frequency so as to make an operation point of the compressor 100 place near TDC=0.

After that, a reference stroke value corresponded to an operational frequency in the determined operation region is determined as shown at step SP8, and a stroke control is performed according to the reference stroke value as shown at step SP9. Herein, an inflection point of the phase difference (PHASE-CS) within an operation region for performing a stable operation and an operational frequency corresponded to the inflection point are pre-detected through experiments and pre-stored. In addition, a stroke by each operational frequency is detected and pre-stored.

After that, by performing the control process repeatedly, the reciprocating compressor can be operated at a mechanical resonance point, namely, maximum efficiency point.

In the stroke control process of the reciprocating compressor, when there is no phase difference variation due to a load variation, the stroke control process can be performed by only comparing an early piston stroke with a piston stroke after a certain time.

In more detail, when the early piston stroke is greater than a reference stroke value after a certain time, an input of the compressor is decreased, when the early piston stroke is smaller than a reference stroke value after a certain time, an input of the compressor is increased (not shown).

As described above, it is possible to improve an operational efficiency by controlling a stroke by varying an operational frequency so as to place an operation distance of a piston near TDC=0 as a resonance frequency region.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A stroke control apparatus of a reciprocating compressor, comprising:

a reciprocating compressor;

a current detecting unit for detecting a current applied to a motor of the reciprocating compressor;

a stroke detecting unit for detecting a piston stroke by using the current applied to the motor of the reciprocating compressor;

a phase difference detecting unit for detecting a phase difference between the piston stroke from the stroke detecting unit and the current from the current detecting unit;

an operational frequency determining unit for determining an operational frequency corresponding to an operation region according to the detected phase difference;

a frequency/stroke storing unit for storing a piston stroke value based on the determined operational frequency;

a reference stroke value determining unit for determining a reference stroke value corresponding to the determined operational frequency by using the stroke value pre-stored in the frequency/stroke storing unit;

a control unit for comparing the reference stroke value with a present piston stroke value after a certain time point and outputting a stroke control signal according to the comparison result; and an inverter for varying an operational frequency and a voltage applied to the motor of the reciprocating compressor according to the stroke control signal of the control unit.

2. The apparatus of claim 1, wherein the operational frequency determining unit includes:

an operation region storing unit for storing the detected phase difference between the current and the piston stroke within a high efficiency operation region;

a comparator for comparing the phase difference detected in the phase difference detecting unit with a phase difference within the operation region; and an operational frequency determiner for adding/subtracting the operational frequency when the phase difference gets out of the operation region due to a load variation and outputting it.

3. The apparatus of claim 2, wherein the operational frequency determiner determines the operational frequency at a certain time point as an operational frequency when the operational frequency at the certain time point places within the operation region by adding/subtracting a reference operational frequency in an early operation of the reciprocating compressor by a certain frequency units.

4. The apparatus of claim 2, wherein the operational frequency determiner increases the operational frequency when the phase difference is greater than an upper limit of the operation region.

5. The apparatus of claim 2, wherein the operational frequency determiner decreases the operational frequency when a the phase difference between the current and the piston stroke is smaller than a lower limit of the operation region.

6. The apparatus of claim 1, wherein the inverter can vary a motor input voltage and a frequency.

7. The apparatus of claim 1, wherein the inverter is a single-phase inverter varying a DC voltage into a single-phase AC voltage.

8. A stroke control method of a reciprocating compressor, comprising:

detecting a load variation while a reciprocating compressor operates with a reference operational frequency;

detecting an operational frequency in an operation region by varying an operational frequency when the load variation is detected;

storing a stroke value corresponding to each operational frequency; and performing a stroke control according to a reference stroke value after determining the reference stroke value corresponding to the operational frequency in a high efficiency operation region.

9. A stroke control method of a reciprocating compressor, comprising:

detecting a load variation while a reciprocating compressor operates with a reference operational frequency;

detecting an operational frequency in an operation region by increasing or decreasing an operational frequency when the load variation is detected; and performing a stroke control according to a reference stroke value after determining the reference stroke value corresponding to the operational frequency in a high efficiency operation region; and detecting a phase difference placed in a high efficiency operation region and storing it.

10. A stroke control method of a reciprocating compressor, comprising:

detecting a load variation while a reciprocating compressor operates with a reference operational frequency;

detecting an operational frequency in an operation region by increasing or decreasing an operational frequency when the load variation is detected; and performing a stroke control according to a reference stroke value after determining the reference stroke value corresponding to the operational frequency in a high efficiency operation region; wherein the load variation is detected by checking whether a phase difference between a motor current and a stroke is placed within the high efficiency operation region.

11. A stroke control method of a reciprocating compressor, comprising:

detecting a load variation while a reciprocating compressor operates with a reference operational frequency;

detecting an operational frequency in an operation region by increasing or decreasing an operational frequency when the load variation is detected; wherein the operational frequency detecting step includes the sub-steps of:

increasing the operational frequency when a phase difference between the current and the stroke is greater than an upper limit of the operation region;

decreasing the operational frequency when a phase difference between the current and the stroke is smaller than a lower limit of the operation region; and determining an operational frequency by judging whether the increased/decreased operational frequency places within the operation region; and performing a stroke control according to a reference stroke value after determining the reference stroke value corresponding to the operational frequency in a high efficiency operation region.

12. A stroke control method of a reciprocating compressor, comprising:

detecting an inflection point of a phase difference between a piston stroke and a motor current by increasing or decreasing a reference stroke value;

detecting a load variation after setting a piston stroke at the inflection point of the phase difference between the piston stroke and the motor current as a reference stroke value;

increasing or decreasing the reference operational frequency and decreasing the reference stroke value as a certain value when the load variation is detected and returning to the inflection point detecting step; and controlling a stroke of the piston according to the set reference stroke value when the load variation is not detected.

13. The method of claim 12, wherein the certain value is set through experiments so as to detect an inflection point of the phase difference between the piston stroke and the current easily.

14. The method of claim 12, wherein the returning step includes the sub-steps of:

increasing the operational frequency when an inflection point of the phase difference between the piston stroke and the current is greater than an upper limit of a high efficiency operation region; and decreasing the operational frequency when a phase difference between the current and the stroke is smaller than a lower limit of the operation region.

15. The method of claim 12, wherein the load variation is detected by using a phase difference between the motor stroke and the motor current.

16. A stroke control method of a reciprocating compressor, comprising:

determining a phase variation placed in a high efficiency operation region and storing phase difference value;

decreasing an input of a compressor when there is no phase variation due to a load variation and an early piston stroke is greater than a reference stroke value after a certain point in time; and increasing the input of the compressor when there is no phase variation due to the load variation and the early piston stroke is smaller than the reference stroke value after the certain point in time.

17. The method of claim 16, wherein the load variation is detected by using the phase difference value between a motor stroke and a motor current.

* * * * *